US007712679B2

(12) United States Patent
Onozawa

(10) Patent No.: US 7,712,679 B2
(45) Date of Patent: May 11, 2010

(54) MIST EJECTION HEAD, IMAGE FORMING APPARATUS COMPRISING MIST EJECTION HEAD, AND LIQUID EJECTION APPARATUS COMPRISING MIST EJECTION HEAD

(75) Inventor: Sho Onozawa, Kanagawa-ken (JP)

(73) Assignee: Fujifilm Corporation, Tokyo (JP)

( * ) Notice: Subject to any disclaimer, the term of this patent is extended or adjusted under 35 U.S.C. 154(b) by 72 days.

(21) Appl. No.: 11/812,659

(22) Filed: Jun. 20, 2007

(65) Prior Publication Data

US 2008/0001003 A1 Jan. 3, 2008

(30) Foreign Application Priority Data

Jun. 28, 2006 (JP) ..... 2006-178170

(51) Int. Cl.
*B05B 3/04* (2006.01)
*B41J 2/04* (2006.01)

(52) U.S. Cl. ..... 239/102.1; 239/102.2; 347/54; 347/46; 347/53

(58) Field of Classification Search ..... 239/102.1; 347/46–55
See application file for complete search history.

(56) References Cited

U.S. PATENT DOCUMENTS 4,751,534 A * 6/1988 Elrod et al. ..... 347/46
6,154,235 A * 11/2000 Fukumoto et al. ..... 347/46
6,182,907 B1 * 2/2001 Nakagawa et al. ..... 239/102.2
6,598,958 B2 * 7/2003 Aizawa et al. ..... 347/46
2002/0063751 A1 5/2002 Aizawa et al.

FOREIGN PATENT DOCUMENTS

JP 62-85948 A 4/1987
JP 62-111757 A 5/1987
JP 2002-59540 A 2/2002
JP 2002-166541 A 6/2002

* cited by examiner

*Primary Examiner*—Len Tran
*Assistant Examiner*—James S Hogan
(74) *Attorney, Agent, or Firm*—Birch, Stewart, Kolasch & Birch, LLP

(57) ABSTRACT

The mist ejection head has: a nozzle plate in which a nozzle hole for ejecting liquid is formed; a liquid chamber connected to the nozzle hole; an ultrasonic wave generating device which applies an ultrasonic wave to the liquid in the liquid chamber; and a reflective wall which reflects the ultrasonic wave applied to the liquid, wherein: the reflective wall is disposed so as to oppose the nozzle plate and has an axially symmetrical shape comprising a portion of a parabolic surface, the portion including an apex of the parabolic surface and being on an apex side with respect to a focal point of the parabolic surface; an axis of the parabolic surface passes through the nozzle hole; and the focal point of the parabolic surface is positioned in a vicinity of the nozzle hole.

5 Claims, 10 Drawing Sheets

MIST EJECTION HEAD, IMAGE FORMING APPARATUS COMPRISING MIST EJECTION HEAD, AND LIQUID EJECTION APPARATUS COMPRISING MIST EJECTION HEAD

BACKGROUND OF THE INVENTION

1. Field of the Invention

The present invention relates to a mist ejection head, an image forming apparatus comprising a mist ejection head, and a liquid ejection apparatus comprising a mist ejection head, and more particularly, to a mist ejection head which uses a high-focus low-attenuation type of reflector for a mist ejection head, and an image forming apparatus and a liquid ejection apparatus comprising such a mist ejection head.

2. Description of the Related Art

Conventionally, image forming apparatuses are known which form desired images by atomizing liquid ink to form a cloud of ink, known as an ink mist, and selectively depositing this ink mist onto a recording medium.

For example, each of Japanese Patent Application Publication No. 62-85948 and Japanese Patent Application Publication No. 62-111757 discloses an ink mist image recording apparatus which generates a charged ink mist locally from the front tip of a fine ultrasonic vibrating needle which vibrates ultrasonically in accordance with an image signal, and performs recording by depositing the ink mist selectively on a recording medium by applying an electric field to the charged ink mist.

Furthermore, for example, each of Japanese Patent Application Publication No. 2002-59540 and Japanese Patent Application Publication No. 2002-166541 discloses a liquid ejection apparatus in which an ultrasonic wave is supplied to the ink inside a cavity for storing ink provided inside an ink tank, by means of a piezoelectric transducer (oscillator) provided on the bottom surface of cavity, the ultrasonic wave is reflected by the inner walls of the cavity, which are formed with a parabolic cross-section, the reflected wave concentrates at the focal point of the parabola, thereby raising the acoustic energy density in the ink, and ink is sprayed in the form of a mist from an ejection port formed in the vicinity of the focal point.

An ultrasonic wave of the MHz order is generally used to create a mist of liquid ink. More specifically, the method of creating a mist of a liquid ink uses cavitation atomization based on a cavitation phenomenon, or capillary atomization based on a capillary wave. Using the latter method enables the generation of a mist having more uniform particle size, and it also has good energy efficiency.

In the case of capillary atomization, a capillary wave is generated by applying a planar wave from below in the direction of the free liquid surface, and if the planar wave has a frequency and amplitude at or above a certain level, then a capillary wave starts to oscillate. Consequently, as the capillary wave grows, minute liquid droplets break away from the peaks of the wave, thereby creating a mist.

In this case, as shown in Japanese Patent Application Publication No. 2002-59540 and Japanese Patent Application Publication No. 2002-166541, for example, the inner walls of a cavity of the ink tank which reflect an ultrasonic wave are designed to form a reflector having a parabolic surface shape, which increases the energy efficiency by focusing the ultrasonic wave in the region of the wavelength level.

FIG. 8 shows a cross-sectional view of a conventional mist ejection head which uses a parabolic surface-shaped reflector of this kind.

The conventional mist ejection head 100 shown in FIG. 8 comprises an ink tank 110, a cavity section 112 for storing ink which is provided inside the ink tank 110, and an ultrasonic wave generating device 114 provided in the bottom surface of the cavity section 112. The ultrasonic wave generating device 114 comprises a diaphragm 116 and a piezoelectric element 118.

The inner wall of the cavity section 112 forms a reflector (reflective wall) 120 which reflects an ultrasonic wave generated by the ultrasonic wave generating device 114. The reflector 120 has a parabolic form, with a cross-sectional shape such as that shown on the right-hand side of the drawing. Furthermore, the upper end side of the cavity section 112 forms a straight cylinder section 122 having a straight shape, and the focal point 124 of the parabola formed by the cross-sectional shape of the reflector 120 is positioned in the center of the upper part of this straight cylinder section 122.

Moreover, a nozzle plate 126 is formed on the upper side of the cavity section 112, and a nozzle 128, which is an opening for ejecting ink, is formed at a position corresponding to the focal point 124. Furthermore, an ink supply channel 130 for supplying ink to the cavity section 112 from the sides, is provided at the bottom surface of the cavity section 112.

When ejecting an ink mist, an ultrasonic wave 132 is applied (in an approximately planar shape) in parallel with the axial direction of the parabola formed by the cross-sectional shape of the reflector 120, from the ultrasonic wave generating device 114, to the ink inside the cavity section 112. The ultrasonic wave 132 is reflected by the reflector 120. Since the reflector 120 has the cross-section of a parabolic shape, the reflected ultrasonic wave 132 is concentrated at the focal point 124 of the parabola.

Moreover, since the nozzle 128 is formed at the position of the focal point 124, then the ultrasonic wave 132 is concentrated at the nozzle 128, the acoustic energy of the ink is raised at the nozzle 128, and an ink droplet is ejected in the form of an ink mist, from the nozzle 128.

In this way, in the mist ejection head 100 according to the related art, the cross-sectional shape of the reflector (reflective wall) 120 is formed to have a parabolic shape, and furthermore, as shown on the right-hand side of FIG. 8, the portion P1 which is situated on the farther side than the focal point F of the parabola with respect to the apex C (in the case of FIG. 8, the portion of the parabola below the focal point F) is used as the reflective surface.

Next, the effective amplitude focusing factor (magnification) in a mist ejection head using the conventional parabolic surface-shaped reflector shown in FIG. 8 is described below.

Here, a case is considered in which the vibrational energy of an acoustic source (the ultrasonic wave generating device 114) is focused at the inlet of the nozzle (the side of the nozzle 128 adjacent to the cavity section 112), by means of the parabolic surface-shaped reflector (reflective wall 120) shown in FIG. 8.

Firstly, the geometrical focusing factor "m" of the energy when using a parabolic surface-shaped reflector is given by the following equation, (1).

$$m=(D^2-d^2)/\lambda^2 \quad (1)$$

As shown in FIG. 8, D (m) is the diameter (inlet diameter) of the inlet side $I_t$ of the reflector (namely, the diameter of the bottom surface side of the cavity section 112), and d (m) is the diameter (outlet diameter) of the outlet side $O_t$ of the reflector (namely, the diameter of the upper end side of the cavity section 112). Furthermore, λ is the wavelength of the longitudinal wave in a fluid, which is expressed by the ratio between the speed of sound in a fluid (speed of propagation of longitudinal wave) v (m/s) and the frequency f (Hz) of the sound source, as indicated by the following equation, (2).

$$\lambda=v/f \tag{2}$$

Moreover, the vibrational energy of a continuous body is directly proportional to the square of the amplitude, and the amplitude amplification rate is the square root of m, or √(m).

Therefore, the effective amplitude focusing factor Γ is defined by the following equation, (3), as the product of the geometric focusing factor of the amplitude due to the reflector, √(m), and the transmissibility T based on the viscous damping.

$$\Gamma=T\times\sqrt{(m)} \tag{3}$$

Here, the transmissibility T is given by the following equation, (4).

$$T=\exp(-\alpha L) \tag{4}$$

Here, the coefficient α is $\alpha=0.8361\times\mu f^2\times10^{-13}$ (neper·$m^{-1}$), L(m) is the propagation distance, and μ(cP) is the coefficient of viscosity.

By consolidating the aforementioned equations, the effective amplitude focusing factor Γ is given by the following equation, (5).

$$\Gamma=f\sqrt{(D^2-d^2)}/v\times\exp(0.8361\times\mu f^2\times10^{-13}\times L) \tag{5}$$

Next, the shape of the reflector (reflective wall 120) is described below. As shown in FIG. 9, the reflector (reflective wall 120) has a parabolic surface shape, having a cross-sectional shape which comprises a portion of a parabola having axial symmetrical (as shown on the left-hand side of FIG. 9) on the far side of the focal point F of the parabola from the apex C of same (in the case of the parabola shown in FIG. 9, the portion below the focal point F).

Here, in order to describe the reflector (reflective wall) 120 in terms of an equation, the parabolic surface shape of the reflector is expressed by the following equation, (6), using the coordinate axes r and z, as shown on the right-hand side in FIG. 9.

$$z(r)=(g+p+u+q)-(a_1/R_{B1})r^2 \tag{6}$$

The meaning of the respective symbols used in the equation (6) is as described below.

Firstly, as shown in FIG. 9, the radius (inlet radius) of the inlet side $I_t$ of the reflector (the bottom surface side of the cavity section 112) is taken to be $R_{B1}$, the radius (outlet radius) of the outlet side $O_t$ of the reflector (the upper side of the cavity section 112) is taken to be $R_{A1}$, the height of the parabola is taken to be h as illustrated on the left-hand side of FIG. 9, and the distance between the focal point F and the apex C is taken to be p.

In this case, $a_1$ is defined by the following equation, (7).

$$h=a_1R_{B1} \tag{7}$$

If $a_1$ is defined in this way, then by means of a simple calculation, the coefficient of the quadratic term of this parabola (the coefficient of $r^2$), A, is $a_1/R_{B1}$.

Moreover, since the distance p between the focal point F of the parabola and the apex C of same is generally expressed by 1/(4A), using the coefficient A of the quadratic term ($r^2$), then this distance p can be expressed as shown below in the equation (8), using the above results.

$$p=R_{B1}/(4a_1) \tag{8}$$

Furthermore, the length q of the reflector in the axial direction shown on the right-hand side of FIG. 9 is expressed by the following equation, (9).

$$q=(a_1/R_{B1})\times(R_{B1}^2-R_{A1}^2) \tag{9}$$

Moreover, from the drawing, the length g of the straight cylinder portion 122 of the cavity section 112 in the axial direction is expressed by the following equation, (10).

$$g=h-(p+q) \tag{10}$$

Furthermore, as shown in FIG. 9, it is known that if the reflector has the shape of a parabolic surface, then the propagation distance $L_1$ of the ultrasonic wave until reaching the focal point F, after the ultrasonic wave has entered in parallel to the axis of the parabolic surface from the inlet side $I_t$ of the cavity section 112 and has been reflected by the parabolic surface, is generally a characteristic property of the parabolic surface and is a uniform distance regardless of the position of reflection. Consequently, looking in particular at a case where the ultrasonic wave is reflected at the point of radius $R_{A1}$ on the outlet side $O_t$ of the cavity section 112, from the drawing, it can be seen that the distance $L_1$ can be expressed by the following equation, (11).

$$L_1=q+\sqrt{(R_{A1}^2+g^2)} \tag{11}$$

Here, if calculation is made by formulas (7) to (10), then the following equation, (12), is obtained.

$$L_1=\{(4a_1^2+1)/4a_1\}\times R_{B1} \tag{12}$$

Furthermore, it can be seen that this expression can be further developed to give $L_1=a_1R_{B1}+R_{B1}/4a_1=h+p$.

Moreover, the focal point F of the parabolic surface must be situated to the upper side of the outlet of the cavity section 112, in other words, at least inside the straight cylinder section 122 as shown in FIG. 9, and therefore the condition stated in the formula (13) below is necessary.

$$g\geqq0 \tag{13}$$

As described above, taking the diameter (inlet diameter) on the inlet side $I_t$ of the reflector (the bottom surface side of the cavity section 112) to be D, and taking the diameter (outlet diameter) on the outlet side $O_t$ of the reflector (the upper end side of the cavity section 112) to be d, then "$D=2R_{B1}$" and "$d=2R_{A1}$" are satisfied. Therefore, by using formulas (7) to (10) to rewrite formula (13), the following relationship, (14), is obtained. In other words, in order that the focal point F is positioned inside the straight cylinder section 122, it is necessary to satisfy the following relationship, (14).

$$d\geqq D/2a_1 \tag{14}$$

Here, considering a case where g=0 as an ideal state, the diameter (outlet diameter) d at the outlet side $O_t$ of the reflector (the upper end side of the cavity section 112) is redefined by the following equation, (15).

$$d=\min(d)=D/2a_1 \tag{15}$$

Here, min(d) is a symbol which expresses the minimum value of d.

In this way, the effective focusing factor Γ is expressed by the following equation, (16), as a function of the speed v of sound in the fluid, the frequency f of the acoustic source, the coefficient μ of viscosity, the diameter u of the ink supply channel (see FIG. 9), the diameter (inlet diameter) D on the inlet side $I_t$ of the reflector, and the value $a_1$ defined in formula (7) above.

$$\Gamma(v, f, \mu, u, D, a_1) = \frac{fD\sqrt{4a_1^2-1}}{2a_1 v e^{0.8361\times\mu f^2\times10^{-13}u+\frac{4a_1^2+1}{8a_1}D}} \tag{16}$$

Moreover, this equation, (16), is written as shown below in (17), taking γ to be $\gamma=0.8361\times10^{-13}$.

$$\Gamma(v, f, \mu, u, D, a_1) = \frac{fD\sqrt{4a_1^2-1}}{2a_1 v e^{\gamma\mu f^2 u+\frac{4a_1^2+1}{8a_1}D}}, \quad \gamma = 0.8361\times10^{-13} \tag{17}$$

In this way, it can be seen that if the effective focusing factor Γ is considered to be a function of D and $a_1$ only, then the turning values in the D direction and the $a_1$ direction are situated on a curve in the plane D-$a_1$, as given by the following equations, (18) and (19).

$$D|_{\partial\Gamma/\partial D=0} = \frac{8a_1}{\gamma\mu f^2(4a_1^2+1)} \tag{18}$$

$$D|_{\partial\Gamma/\partial a1} = \frac{8a_1}{\gamma\mu f^2(4a_1^2-1)^2} \tag{19}$$

For example, FIG. 10 shows the effective focusing factor Γ(D, $a_1$) for various values of D and $a_1$, when v=1500 (m/s), f=10 (MHz), μ=20 (cP) and u=0 (m). These contour-shaped curves indicating the values of the effective focusing factor Γ(D, $a_1$) are known as "contour lines".

In FIG. 10, two curves C1 and C2 which intersect these contour lines are depicted, and the curve C1 is a curve which gives the maximum value of Γ when the value of $a_1$ given by equation (18) is uniform, and the curve C2 is a curve which gives the maximum value of Γ when the value of the D given by equation (19) is uniform.

The maximum value of the effective focusing factor Γ obtained for all of the values of (D, $a_1$) is located at an intersection of these two curves C1 and C2. This is obtained by solving the following equation, (20).

$$\partial\Gamma/\partial D=\partial\Gamma/\partial a_1=0 \tag{20}$$

By solving this equation, (20), then the values of D and $a_1$ which give the maximum value of the effective focusing factor Γ, namely, D' and $a_1$', are obtained as shown in the following equation, (21).

$$D' = \frac{\sqrt{3}}{\gamma\mu f^2}, \quad a_1' = \frac{\sqrt{3}}{2} \tag{21}$$

Moreover, here, the maximum value of the effective focusing factor Γ, namely, max (Γ), is given by the following equation, (22).

$$\max(\Gamma) = \Gamma(D', a_1') = \frac{\sqrt{3}}{v\gamma u f e^{1+\gamma\mu f^2 u}} \tag{22}$$

In the case of FIG. 10, when these values are actually calculated, the results shown in the following equation, (23), are obtained. In other words, the maximum effective focusing factor Γ in this case is approximately 20.74.

$$D'\approx10.36\ [\text{mm}],\ a'_1\approx0.866,\ \max(\Gamma)\approx20.74 \tag{23}$$

However, in a mist ejection head which uses a conventional parabolic surface-shaped reflector such as that described above, since a portion of the parabola having axial symmetry (such as that shown on the right-hand side of FIG. 8) which is a far from the apex C with respect to the focal point F of same, (namely, the portion of the parabola below the focal point F in the case of FIG. 8) P1, is used as a reflector, then the area of the direct wave region which does not contribute to focusing is wasted and hence the spatial usage efficiency of the cavity section is poor.

Furthermore, if, on the other hand, the outlet diameter of the cavity section is reduced in order to reduce the direct wave region, then the propagation distance of the ultrasonic wave until the focal point of the parabola formed by the cross-sectional shape of the reflector becomes long, and therefore the effective focusing factor declines due to viscous damping.

SUMMARY OF THE INVENTION

The present invention has been contrived in view of these circumstances, an object thereof being to provide a mist ejection head, and an image forming apparatus and a liquid ejection head comprising a mist ejection head, in which the spatial usage efficiency of a cavity section of a parabolic surface-shaped reflector can be improved, while also improving the effective focusing factor without causing the propagation distance of an ultrasonic wave until the focal point to become long even if the outlet diameter of the cavity section is restricted.

In order to attain the aforementioned object, the present invention is directed to a mist ejection head, comprising: a nozzle plate in which a nozzle hole for ejecting liquid is formed; a liquid chamber connected to the nozzle hole; an ultrasonic wave generating device which applies an ultrasonic wave to the liquid in the liquid chamber; and a reflective wall which reflects the ultrasonic wave applied to the liquid, wherein: the reflective wall is disposed so as to oppose the nozzle plate and has an axially symmetrical shape comprising a portion of a parabolic surface, the portion including an apex of the parabolic surface and being on an apex side with respect to a focal point of the parabolic surface; an axis of the parabolic surface passes through the nozzle hole; and the focal point of the parabolic surface is positioned in a vicinity of the nozzle hole.

In this aspect of the present invention, since the portion of a parabola on the side of the apex from the focal point of the parabola is used as the reflector (reflective wall) of the mist ejection head, then the diameter (outlet diameter) of the outlet side of the reflector can be restricted to the nozzle diameter, at minimum, and furthermore, since there is no consequent lengthening of the propagation distance of the ultrasonic wave, then it is possible to improve the effective focusing factor in comparison with the related art.

Preferably, the ultrasonic wave generating device is disposed in a vicinity of the nozzle hole on an opposite side of the nozzle plate from the liquid chamber, in such a manner that the ultrasonic wave generated by the ultrasonic wave generating device is applied to the liquid in the liquid chamber via the nozzle plate, travels in parallel to the axis toward the reflective wall, is reflected by the reflective wall and focuses at the focal point.

In this aspect of the present invention, by disposing an ultrasonic wave generating device in the vicinity of the nozzle, the heat generated by the ultrasonic wave generating device is applied to the meniscus of the liquid, and hence the viscosity can be reduced. Moreover, since a pressure is applied directly to the nozzle plate from the ultrasonic wave generating device, an elastic wave is generated efficiently in the nozzle plate, in comparison with the case of indirect application of pressure via the fluid, and by transmitting this wave to the nozzle edge, it is possible to assist the generation of a capillary wave. Furthermore, rather than forming a nozzle in a slit shape by means of an opening of the ultrasonic wave generating device itself, a nozzle hole is formed in the nozzle plate and the ultrasonic wave generating device is disposed in the vicinity of the nozzle hole in the nozzle plate, and therefore the dimensional accuracy of the ultrasonic wave generating device does not affect the dimensional accuracy of the nozzle hole. Moreover, since the ultrasonic wave generating device is disposed on the opposite side of the nozzle plate from the liquid chamber, it is possible readily to form wires to the electrode of the ultrasonic wave generating device.

Preferably, a supply channel which supplies the liquid to the liquid chamber is formed between a liquid chamber plate in which the liquid chamber is formed, and the nozzle plate, on a side adjacent to the nozzle plate.

In this aspect of the present invention, since the supply channel does not impair the shape of the reflective surface of the reflective wall, then it has little detrimental effect on the reflection and focusing of the ultrasonic wave, and furthermore, the occurrence of air bubbles inside the liquid chamber can be suppressed.

In order to attain the aforementioned object, the present invention is also directed to an image forming apparatus comprising any one of the above-mentioned mist ejection heads.

In this aspect of the present invention, it is possible to eject a liquid mist efficiently, and therefore images can be formed efficiently.

In order to attain the aforementioned object, the present invention is also directed to a liquid ejection apparatus comprising any one of the above-mentioned mist ejection heads.

In this aspect of the present invention, it is possible to eject a liquid mist efficiently.

As described above, according to the present invention, since the portion of a parabola on the apex side with respect to the focal point of the parabola is used as the reflector (reflective wall) of the mist ejection head, then the diameter (outlet diameter) of the outlet side of the reflector can be restricted to the nozzle diameter, at minimum, and furthermore, since there is no consequent lengthening of the propagation distance of the ultrasonic wave, then it is possible to improve the effective focusing factor in comparison with the related art.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

Figure 1:
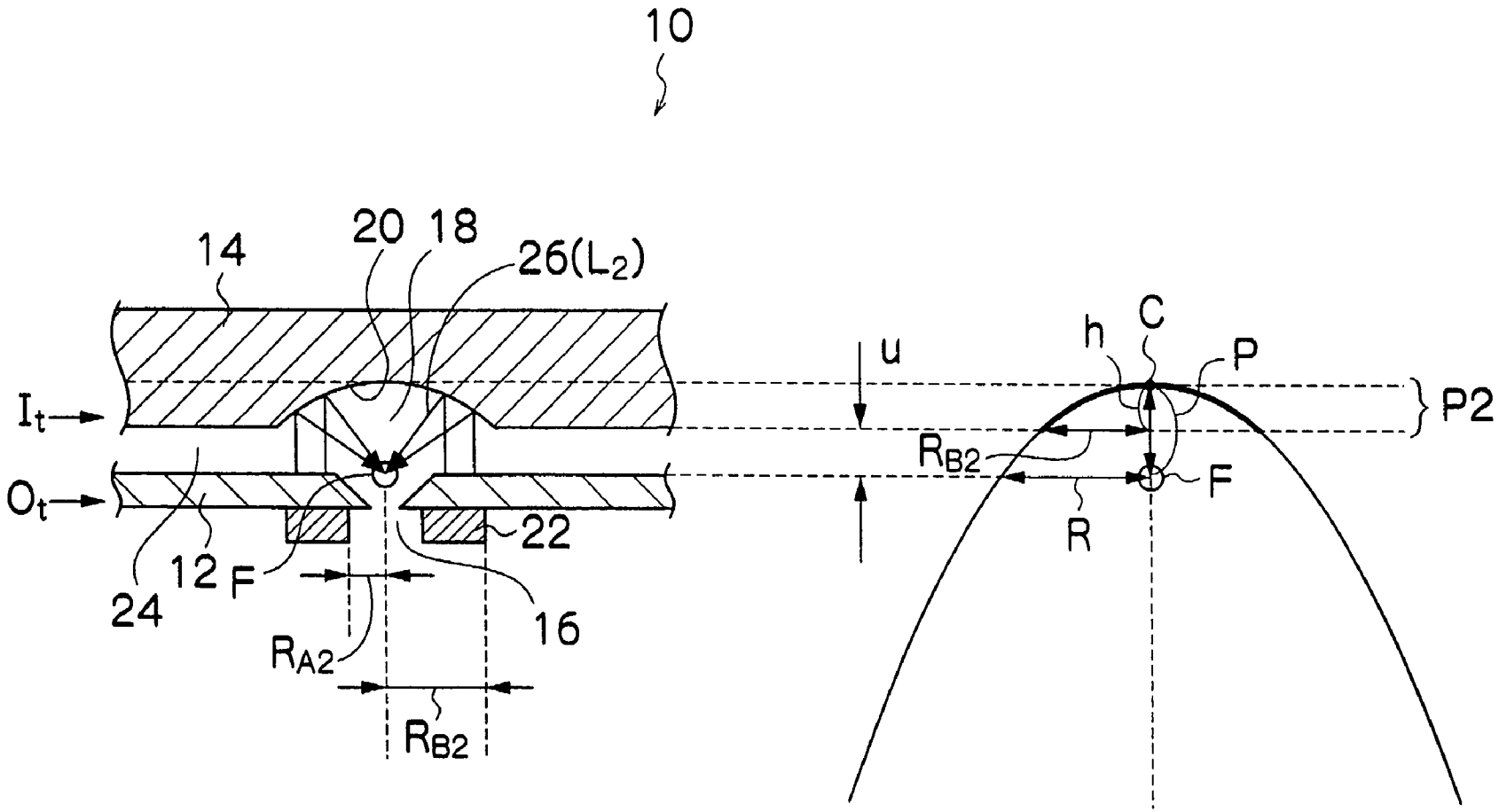
FIG. 1 is a cross-sectional diagram showing the approximate composition of a mist ejection head according to one embodiment of the present invention.

FIG. 1 is a cross-sectional diagram showing the approximate composition of a mist ejection head according to one embodiment of the present invention.

As shown in FIG. 1, the mist ejection head 10 according to the present embodiment is formed by putting a nozzle plate 12 on a liquid chamber plate 14, a nozzle hole 16 (hereinafter, simply called "nozzle 16") for ejecting ink is formed in the nozzle plate 12, and an ink chamber 18 forming a cavity section for storing ink is formed in the liquid chamber plate 14.

The inner wall of the ink liquid chamber 18 that faces the nozzle 16 forms a reflector (reflective wall) 20 which serves to reflect an ultrasonic wave. The nozzle plate 12 also serves as a diaphragm, and a piezoelectric element 22 forming an ultrasonic wave generating device is disposed about the perimeter of the nozzle 16. Moreover, an ink supply channel 24 for supplying ink to the ink chamber 18 is formed on the side of the ink chamber 18 adjacent to the nozzle plate 12.

The reflector 20 is a parabolic surface-shaped reflector (reflective wall), having a cross-sectional shape constituted by a portion of a parabola, as indicated on the right-hand side of FIG. 1, namely, the portion on the apex C side of the parabola from the focal point F of the parabola (in other words, the portion including the apex C above the focal point F in the case of the parabola in FIG. 1) P2. Moreover, the reflector 20 is formed in such a manner that the axis of the parabola passes through the center of the nozzle 16, and the focal point F of the paraboloid is located in a position corresponding to the center of the nozzle 16, on the side of the nozzle plate 12 adjacent to the ink chamber 18.

An ultrasonic wave 26 generated by the piezoelectric element 22 forming the ultrasonic wave generating device is transmitted to the ink inside the ink chamber 18 by means of the nozzle plate 12, which also serves as a diaphragm, and it advances towards the reflector 20 in the form of a planar wave, following the axis of the parabolic surface of the reflector 20. The ultrasonic wave 26 is then reflected by the reflector 20.

In this case, when the ultrasonic wave 26 which was advancing in parallel to the axis of the parabolic surface has been reflected by the parabola-shaped reflector 20, it converges at the focal point F. Moreover, since the focal point F is formed at a position in the center of the nozzle 16, then the ultrasonic wave 26 reflected by the reflector 20 is focused at the position of the nozzle 16. Consequently, the acoustic energy of the ink in the nozzle 16 is raised, and an ink droplet is ejected from the nozzle 16 in the form of an ink mist.

By disposing the piezoelectric element 22 forming the ultrasonic wave generating device in the vicinity of the nozzle in this way, the heat generated by the piezoelectric element 22 is applied to the meniscus of the ink, and therefore it is possible to reduce the viscosity of the ink. Moreover, since a pressure is applied directly to the nozzle plate 12 from the ultrasonic wave generating device, an elastic wave is generated more efficiently in the nozzle plate 12 in comparison with the case of indirect application of pressure via the fluid, and by transmitting this wave to the nozzle edge, it is possible to assist the generation of a surface acoustic wave.

Furthermore, as shown in FIG. 1, the inlet side $I_t$ of the reflector 20 according to the present embodiment is the portion where the parabolic surface forming the reflector 20 is opened to the greatest width about the axis of the parabola, and the radius (inlet radius) at the inlet side $I_t$ of the reflector is taken to be $R_{B2}$. Moreover, the outlet side $O_t$ of the reflector 20 is the section where the piezoelectric element 22 acting as an ultrasonic wave generating device is formed, in the vicinity of the nozzle 16 where the ultrasonic wave 26 reflected by the reflector 20 converges. The radius (outlet radius) of the outlet side $O_t$ of the reflector 20 is taken to be $R_{A2}$.

Figure 8:
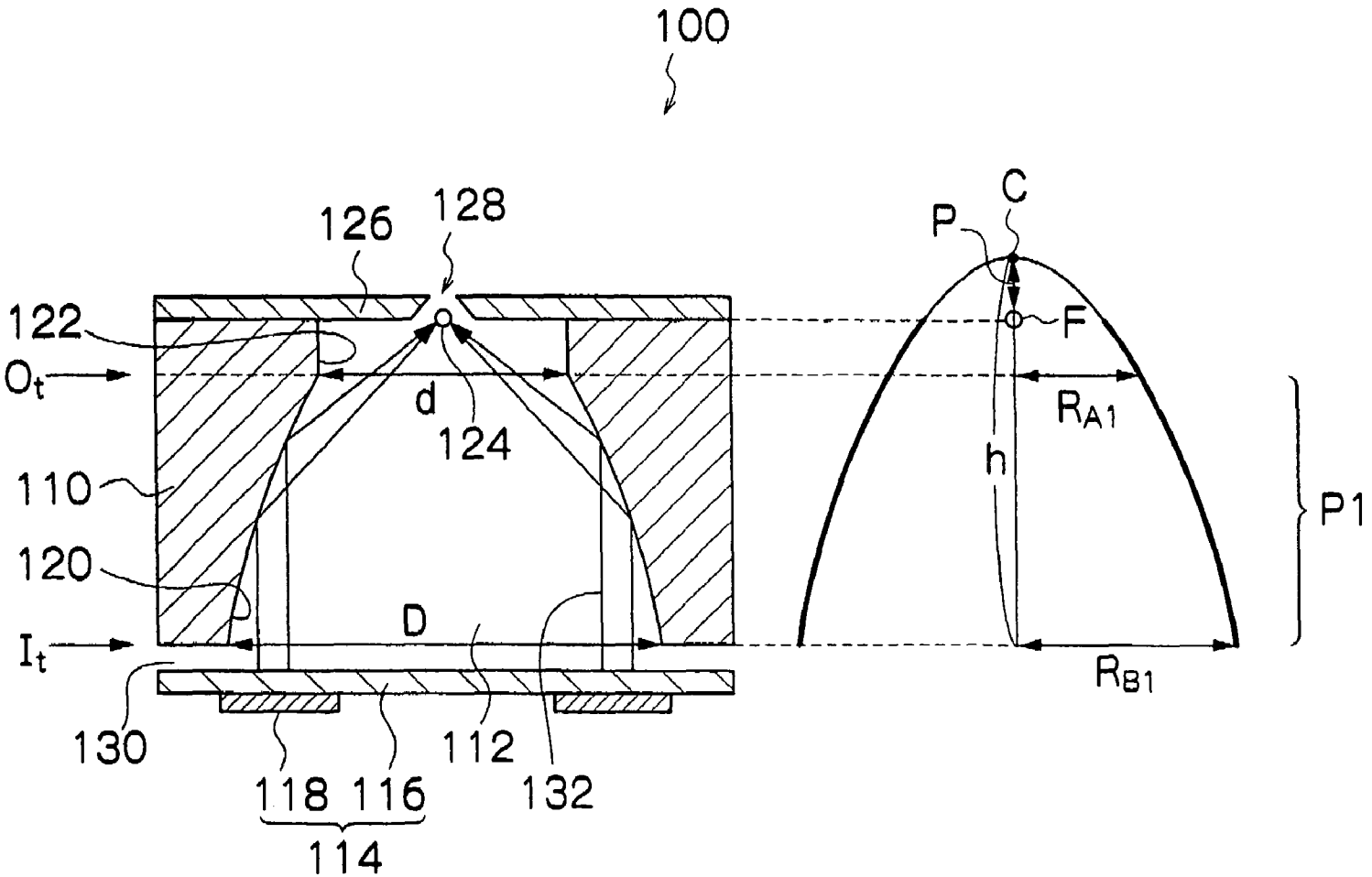
FIG.8 RELATED ART
FIG. 8 is a cross-sectional diagram showing a related art mist ejection head which uses a parabolic surface-shaped reflector.

In the present embodiment, as shown in FIG. 1, the focal point F is situated more closely to the sound source (piezoelectric element 22) than the inlet side $I_t$ of the reflector. In a conventional reflector (reflective wall 120), as shown in FIG. 8, the focal point F is situated further away from the sound source (piezoelectric element 118) than the inlet side $I_t$ of the reflector. The propagation distance L until reaching the focal point F, after the ultrasonic wave 26 generated by the ultrasonic wave generating device (piezoelectric element 22) has been input from the inlet side $I_t$ of the reflector and reflected by the reflector 20, is expressed by the above equation (12), as in the related art.

In this case, in the related art, the diameter (outlet diameter) on the outlet side $O_t$ of the reflector, and the diameter (inlet diameter) on the inlet side $I_t$ of the reflector must satisfy equation (14) stated above; however, in the present embodiment, there is no restriction of this kind, and therefore, it is possible to reduce the diameter $2R_{A2}$ of the outlet side $O_t$ of the reflector, which corresponds to the value d in equation (5), to the order of the nozzle diameter at the minimum, without causing a wasteful increase in the depth of the reflector from the inlet side $I_t$ of the reflector to the outlet side $O_t$ of the reflector.

As equation (9) reveals, in a related art reflector 120 which uses a reflecting surface constituted by the portion of the paraboloid on the far side of the focal point with respect to the apex (the portion P1 in FIG. 8), if the inlet diameter RBI is reduced with respect to a fixed outlet diameter $R_{A1}$, then the length of the reflector 120 in the axial direction (the inlet-outlet distance), q, inevitably becomes longer. Consequently, the propagation distance L of the ultrasonic wave becomes longer. However, in the reflector 20 according to the present embodiment, it is possible to increase the effective focusing factor without lengthening the propagation distance L of the ultrasonic wave.

Since the ultrasonic wave generating device (piezoelectric element 22) is located in the vicinity of the nozzle in this way, then the phase of the ultrasonic wave focused at the nozzle 16 and the phase of oscillation of the piezoelectric element 22 do not necessarily coincide and it can be expected that they will interfere with each other and cause mutual attenuation. However, since there is a several hundred-fold difference between the energy density in the acoustic field generated at the nozzle surface, and the energy density at the focal point, then the aforementioned interference effect is relatively negligible and it does not present a problem.

Figure 9:
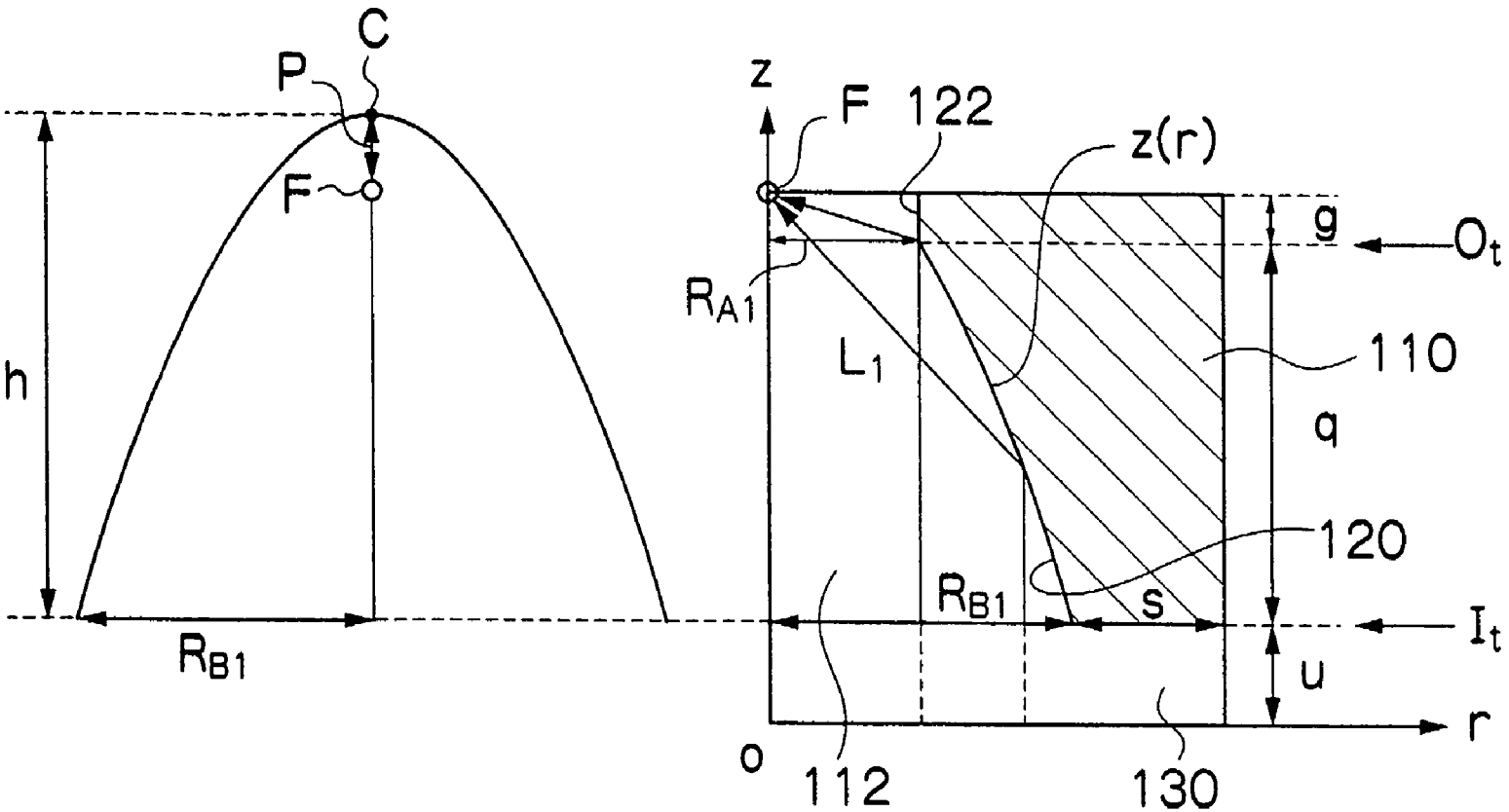
FIG.9 RELATED ART
FIG. 9 is a cross-sectional diagram of one quarter part of the mist ejection head shown in FIG. 8.

Here, in the parabola on the right-hand side in FIG. 1, similarly to FIG. 8 or FIG. 9 relating to the related art, if the ratio $a_2$ of the height h of the parabola with respect to the length $R_{B2}$ of the lateral axis at the inlet side $I_t$ of the reflector is taken to be $h=a_2R_{B2}$, then the coefficient A of the quadratic term $r^2$ of this parabola is $A=a_2/R_{B2}$, and hence the distance p between the focal point F and the apex C of the parabola in FIG. 1, and the length R of the lateral axis at the focal point F, are given respectively by the following equations. More specifically, R is expressed by equation (24) below and p is expressed by equation (25) below.

$$R=R_{B2}/2a_2 \tag{24}$$

$$p=R_{B2}/4a_2 \tag{25}$$

Moreover, from FIG. 1, the diameter u of the ink supply channel 24 is expressed by the following equation, (26).

$$u=p-h=p-a_2R_{B2} \tag{26}$$

Furthermore, as described previously, the propagation distance $L_2$ until reaching the focal point F, as traveled by the ultrasonic wave 26 generated by the ultrasonic wave generating device forming the sound source and reflected by the reflector 20, is generally uniform, regardless of the reflection position at the reflector 20; therefore, considering a case where the ultrasonic wave is reflected at the inlet side $I_t$ of the reflector, the propagation distance $L_2$ is calculated as shown in equation (27) below, by using the value u and the inlet radius $R_{B2}$ of the reflector.

$$L_2=u+\sqrt{(u^2+R_{B2}^2)}=R_{B2}/2a_2=R \tag{b 27}$$

Here, if the surface area of the sound source which contributes to the focusing of the ultrasonic wave 26 is calculated in respect of a related art reflector 120 (see FIG. 8) and a reflector 20 according to the present embodiment, then the surface area $A_1$ of the sound source with respect to the reflector 120 of the related art shown in FIG. 8 is expressed by the following equation (28).

$$A_1=\pi(R_{B1}^2-R_{A1}^2) \tag{28}$$

Moreover, the surface area $A_2$ of the sound source with respect to the reflector 20 according to the present embodiment shown in FIG. 1 is expressed by the following equation, (29).

$$A_2=\pi(R_{B2}^2-R_{A2}^2) \tag{29}$$

If the frequency f is constant, then the focusing factor is dependent on the surface area of the sound source, and supposing that the focusing factor is the same in both the related art and the present embodiment, then the surface areas of the sound sources $A_1$ and $A_2$ are equal. Therefore, supposing that "$A_1=A_2$" is satisfied, then "$R_{B1}^2-R_{A1}^2=R_{B2}^2-R_{A2}^2$" is obtained from equations (28) and (29), and by developing it to a certain degree on the basis of equations (25) and (26), the following equation, (30), is obtained.

$$R_{B2}=2a_2\{u+\sqrt{(u^2-R_{A1}^2+R_{B1}^2+R_{A2}^2)}\} \tag{30}$$

Consequently, from this, the propagation distance $L_2$ of the ultrasonic wave in the case of the reflector 20 according to the present embodiment is expressed by the following equation, (31).

$$L_2=u+\sqrt{(u^2-R_{A1}^2+R_{B1}^2+R_{A2}^2)} \tag{31}$$

Moreover, here, the ideal state shown in equation (15), namely, $d=D/2a_1$, is assumed, in such a manner that the straight cylinder section (straight section) 122 of the related art reflector 120 is eliminated. More specifically, if "$R_{A1}=R_{B1}/2a_1$", which is obtained from "$2R_{A1}=2R_{B1}/2a_1$", is introduced into equation (31), then the following equation (32) is obtained.

$$L_2=\{(2a_1u+1)/2a_1\}\times\sqrt{(4a_1^2u^2+(4a_1^2-1)R_{B1}^2+4a_1^2R_{A2}^2)} \quad (32)$$

Here, if the following equation (33) is satisfied, then the propagation distance $L_2$ of the ultrasonic wave reflected by the reflector 20 according to the present embodiment, at the same focusing factor, is less than the propagation distance $L_1$ of the ultrasonic wave reflected by the reflector 120 according to the related art. Therefore, the effective focusing factor according to the present embodiment, based on viscous damping, is substantially improved with respect to the reflector of the related art.

$$L_2<L_1 \quad (33)$$

Next, the following simultaneous relationships (34) are considered.

$$L_2\leqq L_1,\ ½\leqq a_1,\ 0<R_{B1},\ 0<R_{A2},\ u=0 \quad (34)$$

The second relationship in (34) means that in the related art composition, the outlet diameter is always smaller than the inlet diameter. Moreover, in the fifth relationship in (34), similarly to the investigation of the related art composition described above, the distance from the sound source to the inlet side $I_t$ of the reflector is assumed to take an ideal state, namely, u=0. By solving the relationships in (34), the following relationship, (35), is obtained.

$$0<R_{A2}\leqq R_{B1}\sqrt{(16a_1^4-8a_1^2+5)}/4a_1 \quad (35)$$

Provided that this relationship is satisfied, then at the same geometrical focusing factor, the reflector according to the present embodiment has a shorter propagation distance of the ultrasonic wave compared to the related art reflector, and consequently, it can be seen that the effective focusing factor is improved in comparison with the related art composition. Moreover, the relationship in (35) can be satisfied readily.

Here, for the purpose of comparison, equations (36) and (37) show the propagation distances of the ultrasonic wave in the case of the related art, $L_1$, and in the case of the present embodiment, $L_2$, supposing that the present embodiment has the same geometrical factor as the related art (namely, assuming that the outlet surface of the related art composition coincides with the focal point). Here, the distance from the sound source to the inlet side $I_t$ of the reflector is $u_1$ in the related art, and $u_2$ in the present embodiment.

$$L_1=u_1+\{(4a_1^2+1)/4a_1\}R_{B1} \quad (36)$$

$$L_2=\{(2a_1u_2+1)/2a_1\}\times\sqrt{(4a_1^2u_2^2+(4a_1^2-1)R_{B1}^2+4a_1^2R_{A2}^2)} \quad (37)$$

For example, if $a_1=1.5$, $u_1=u_2=0.5$ (mm), $R_{A1}=0.5$ (mm), $R_{B1}=1.0$ (mm), and $R_{A2}=10$ (μm), then the relationship (35) becomes approximately equal to the relationship (39) below, and this relationship is satisfied.

$$0<10\times10^{-6}<1.374\times10^{-3} \quad (39)$$

In practice, the following relationship, (40), is obtained.

$$L_1=2.166\ [\text{mm}],\ L_2\approx1.567\ [\text{mm}],\ R_{B2}\approx0.866\ [\text{mm}] \quad (40)$$

In this way, the propagation distance in the case of the present embodiment, $L_2=1.567$, is some 27.6% smaller than the propagation distance according to the related art, $L_1=2.166$, since $(2.166-1.567)/2.166\approx0.276$. Moreover, the diameter of the piezoelectric element is substantially equal to the diameter (inlet diameter) on the inlet side $I_t$ of the reflector, but whereas the inlet radius according to the present embodiment is $R_{B2}=0.866$, the inlet radius according to the related art is $R_{B1}=1.0$. Therefore, comparing the diameters, since $(2R_{B1}-2R_{B2})/2R_{B1}=(2.0-1.732)/2.0=0.134$, then the piezoelectric element according to the present embodiment is 13.4% smaller than the diameter of the piezoelectric element according to the related art. As a result, in the present embodiment, at the same focusing factor, the propagation distance is some 27.6% shorter, and the diameter of the piezoelectric element forming the ultrasonic wave generating device is some 13.4% smaller, than in the reflector according to the related art.

In this way, by means of the reflector according to the present embodiment, the effective focusing factor accounting for viscous damping is improved, and the suitability for high-density arrangement is improved, at the same value for the geometrical focusing factor.

Next, the upper limit of the effective focusing factor in the reflector according to the present embodiment is described below.

In the reflector according to the present embodiment, on the basis of equation (27) above, the propagation distance $L_2$ traveled by the ultrasonic wave from the inlet side $I_t$ of the reflector until reaching the focal point after reflection is expressed by the following equation (41).

$$L_2=u+\sqrt{(u^2+R_{B2}^2)} \quad (41)$$

The effective focusing factor in this case is as shown in equation (42) below.

$$\Gamma(v, f, \mu, D_N, u, D)=\frac{f\sqrt{D^2-D_N^2}}{ve^{\gamma\mu f^2 u+\sqrt{u^2+(D/2)^2}}},\quad \gamma=0.8361\times10^{-13} \quad (42)$$

Here, $D=2R_{B2}$ and $D_N=2R_{A2}$. Moreover, as shown in this equation (42), the effective focusing factor Γ does not depend on the value of $a_2$ given by equation (24) or equation (25). This point is a major difference with respect to the case of the related art indicated by equation (16), where the effective focusing factor Γ depends on the value of $a_1$ defined in equation (7).

Furthermore, the point at which the effective focusing factor Γ(D) takes a maximum value in the $R_{B2}$ direction (D direction) is given by the solution of the following quintic equation, (43).

$$\partial\Gamma(D)/\partial D=0 \quad (43)$$

However, the physically significant part of the solution of this equation is that shown in the following equation, (44).

$$D|_{\partial\Gamma/\partial D=0}=\frac{\sqrt{2+\gamma^2\mu^2f^2D_N^2+2\sqrt{1+\gamma^2\mu^2f^4(4_U^2+D_N^2)}}}{\gamma\mu f^2} \quad (44)$$

Moreover, in the reflector according to the related art, the maximum effective focusing factor with respect to a certain value of D is given by the following equation, (45).

$$\Gamma(D, a_1|_{\partial\Gamma/\partial a1=0}) \quad (45)$$

Here, the value of $a_1$ which gives the maximum value of the effective focusing factor is the value of $a_1$ where $\partial\Gamma/\partial a_1=0$, and this is obtained by solving the following quartic equation (46).

$$a_1^4 - \frac{1}{2}a_1^4 - \frac{1}{2\gamma\mu f^2 D}a_1 + \frac{1}{16} = 0 \quad (46)$$

Figure 2:
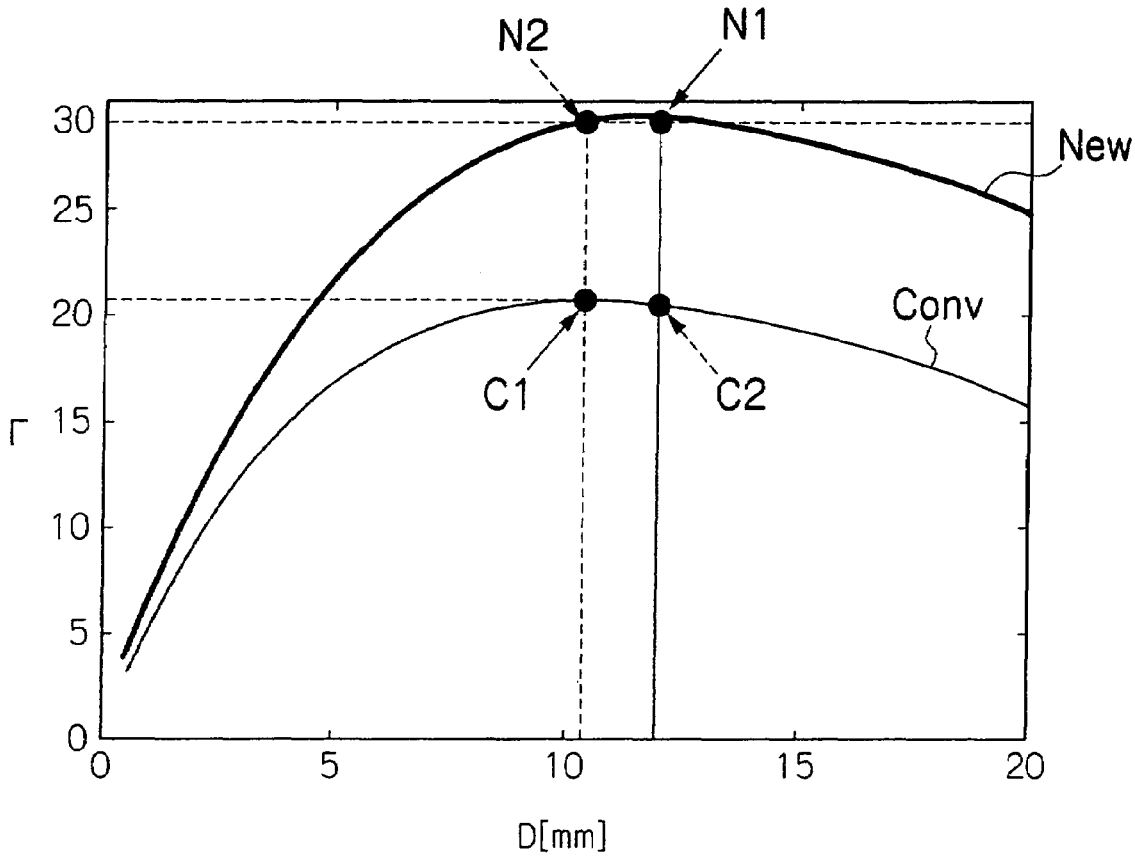
FIG. 2 is a graph of the effective focusing factor for comparing the differences in the focusing factor between the one embodiment and the related art.

In FIG. 2, the maximum effective focusing factor in a related art type reflector, as obtained by determining the values of $a_1$ mathematically for the respective values of D by using the Hitchcock-Bairstow method and applying them to equation (45) above, and the effective focusing factor of the reflector according to the present embodiment as expressed by equation (42) above, are plotted according to the same conditions. In other words, FIG. 2 shows the difference in the focusing factor according to the related art and the present embodiment, when v=1500 (m/s), f=10 (MHz), μ=20 (cP), u=0 (m), and $D_N$=20 (μm), plotting D on the horizontal axis and Γ on the vertical axis.

In FIG. 2, "New" is a graph indicating the focusing factor $\Gamma_{New}(D)$ in the reflector according to the present embodiment, and "Conv" is a graph indicating the focusing factor $\Gamma_{Conv}(D)$ in the reflector according to the related art.

The point N1 on the graph "New" of the focusing factor according to the present embodiment is the point where the focusing factor $\Gamma_{New}(D)$ becomes a maximum, and this value is given by the equation below, (48). Furthermore, the point C1 on the graph "Conv" of the focusing factor according to the related art is the point where the focusing factor $\Gamma_{Conv}(D)$ becomes a maximum, and this value is given by the equation below, (47).

$$\Gamma_{conv.}(D'_{conv.}) \equiv \max(\Gamma_{conv}(\approx 20.74 \quad (47)$$

$$\Gamma_{New}(D'_{New}) \equiv \max(\Gamma_{New}) \equiv 29.33 \quad (48)$$

Furthermore, the point N2 on the graph "New" and the point C2 on the graph "Conv" are points where the values of D expressing the opening diameters of the reflectors are replaced with each other. These values are expressed in the following equations, where equation (49) indicates the value relating to the related art and the equation (50) indicates the value relating to the present embodiment.

$$\Gamma_{conv.}(D'_{New}) \approx 20.54 \quad (49)$$

$$\Gamma_{New}(D'_{conv.}) \approx 29.04 \quad (50)$$

Moreover, the value of D at the point N1 on the graph "New" where the focusing factor $\Gamma_{New}(D)$ in the present embodiment is a maximum value is given by the following equation, (52), and similarly, the value of D at the point C1 on the graph "Conv" where the focusing factor $\Gamma_{Conv}(D)$ according to the related art is a maximum value is given by the following equation, (51).

$$D'_{conv.} \approx 10.36[\text{mm}] \quad (51)$$

$$D'_{New} \approx 11.96[\text{mm}] \quad (52)$$

Figure 10:
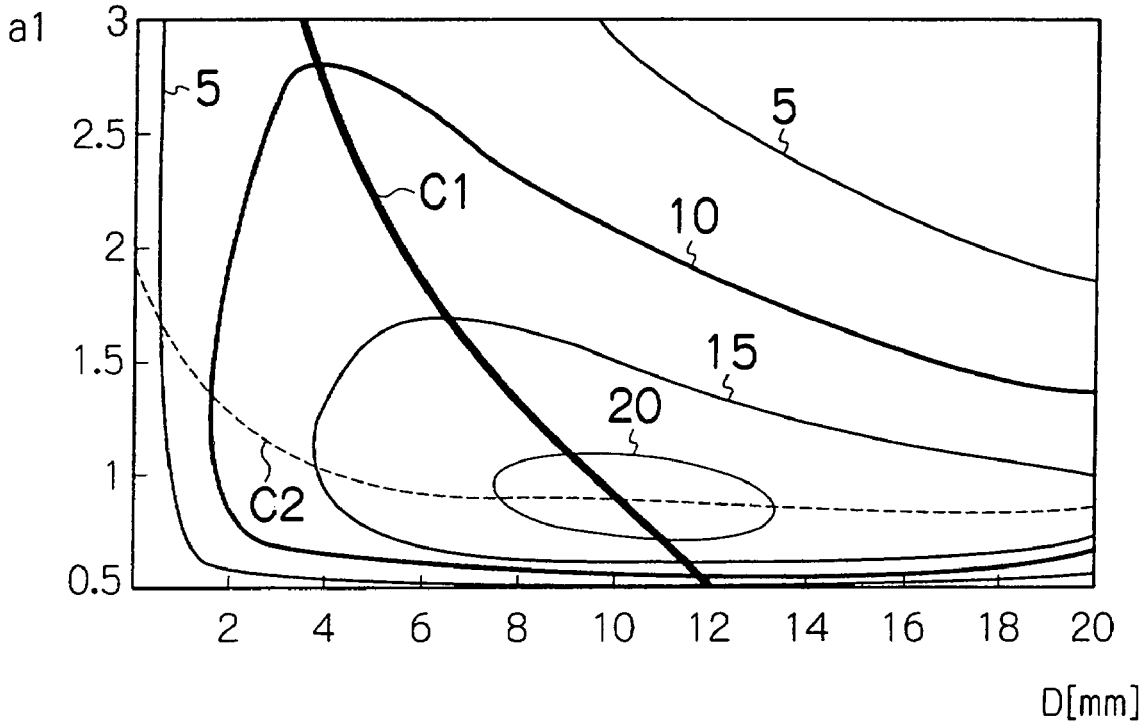
FIG.10 RELATED ART
FIG. 10 is a graph of contour lines showing the focusing factor in the mist ejection head according to the related art.

The graph "Conv" relating to the related art in FIG. 2 is a graph which indicates the values of Γ observed by following the value of $a_1$ that gives the maximum value of Γ, with respect to particular values of D in FIG. 10 relating to the related art.

Moreover, the value of $a_1$ in the equation (47) above is given by the following equation (53).

$$a1 \equiv a'_{conv.} \approx 0.866 \quad (53)$$

Furthermore, the value of $a_1$ in the equation (49) above is given by the following equation (54).

$$a_1 \approx 0.842 \quad (54)$$

In this way, as revealed by FIG. 2, the effective focusing factor $\Gamma_{Conv}(D)$ of the reflector according to the related art never exceeds the effective focusing factor $\Gamma_{New}(D)$ of the reflector according to the present embodiment, at all values of D.

Furthermore, in the present embodiment, from equation (48) above, the upper limit of the effective focusing factor is $\Gamma_{New}(D)$=29.33, which is an improvement of more than 41% with respect to the upper limit of the effective focusing factor according to the related art, $\Gamma_{Conv}(D)$=20.74.

From equation (52) above, the value of D in this case is $D_{New}$=11.96 in the case of the present embodiment, and this value is more than 15% greater than the value of D according to the related art, $D_{Conv}$=10.36, given by equation (51) above.

Figure 3:
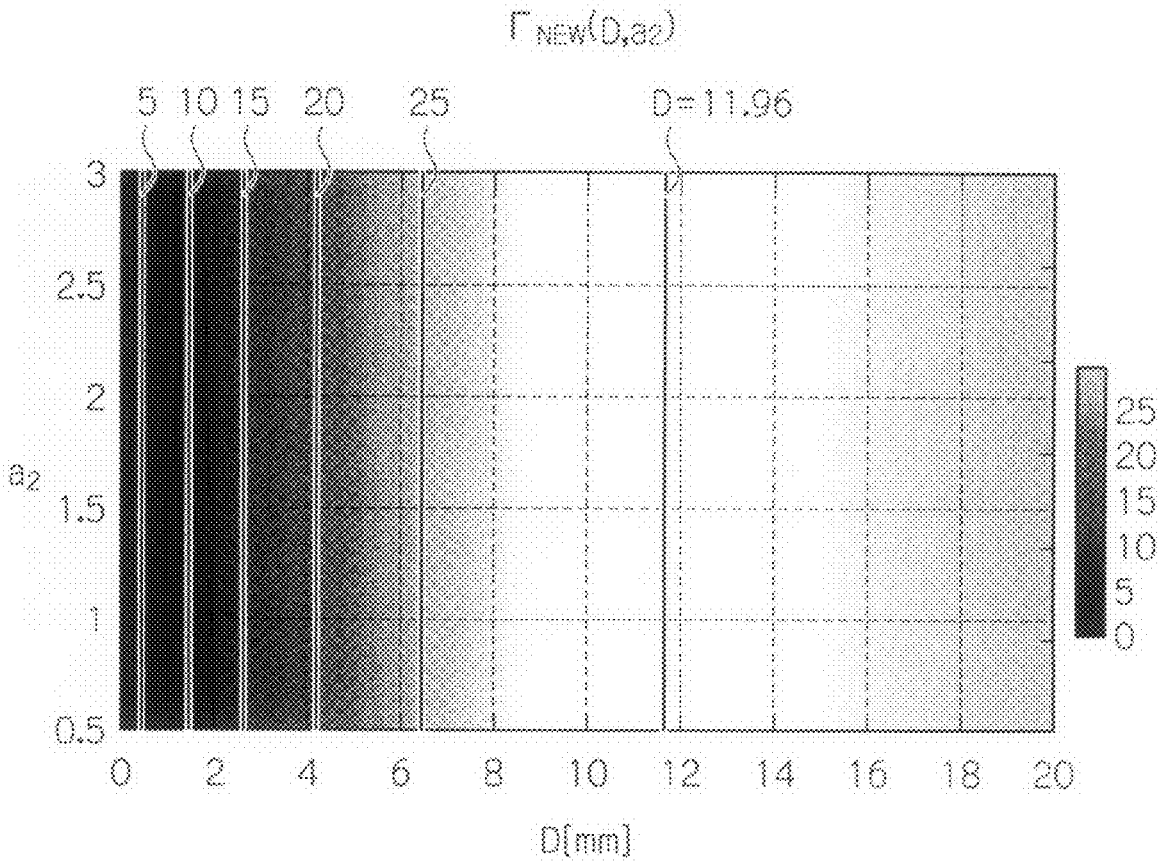
FIG. 3 is a graph of a contour line showing the focusing factor of a reflector according to the one embodiment.

Moreover, FIG. 3 shows contour lines according to the present embodiment, which correspond to the contour lines according to the related art shown in FIG. 10. As stated previously, in the present embodiment, there is no dependence on the value of $a_1$ ($a_2$ in the present embodiment), unlike the related art, and therefore the graph does not form contour-shaped lines. In other words, in the present embodiment, as stated previously, $\Gamma_{New}$ assumes a maximum value at D=11.96, but since this value is not dependent on $a_2$, then in the graph in FIG. 3, the straight line parallel to the $a_2$ axis at D=11.96 indicates the maximum value of the effective focusing factor $\Gamma_{New}$.

Below, an image forming apparatus and a liquid ejection apparatus which comprise the mist ejection head described above will be explained.

Figure 4:
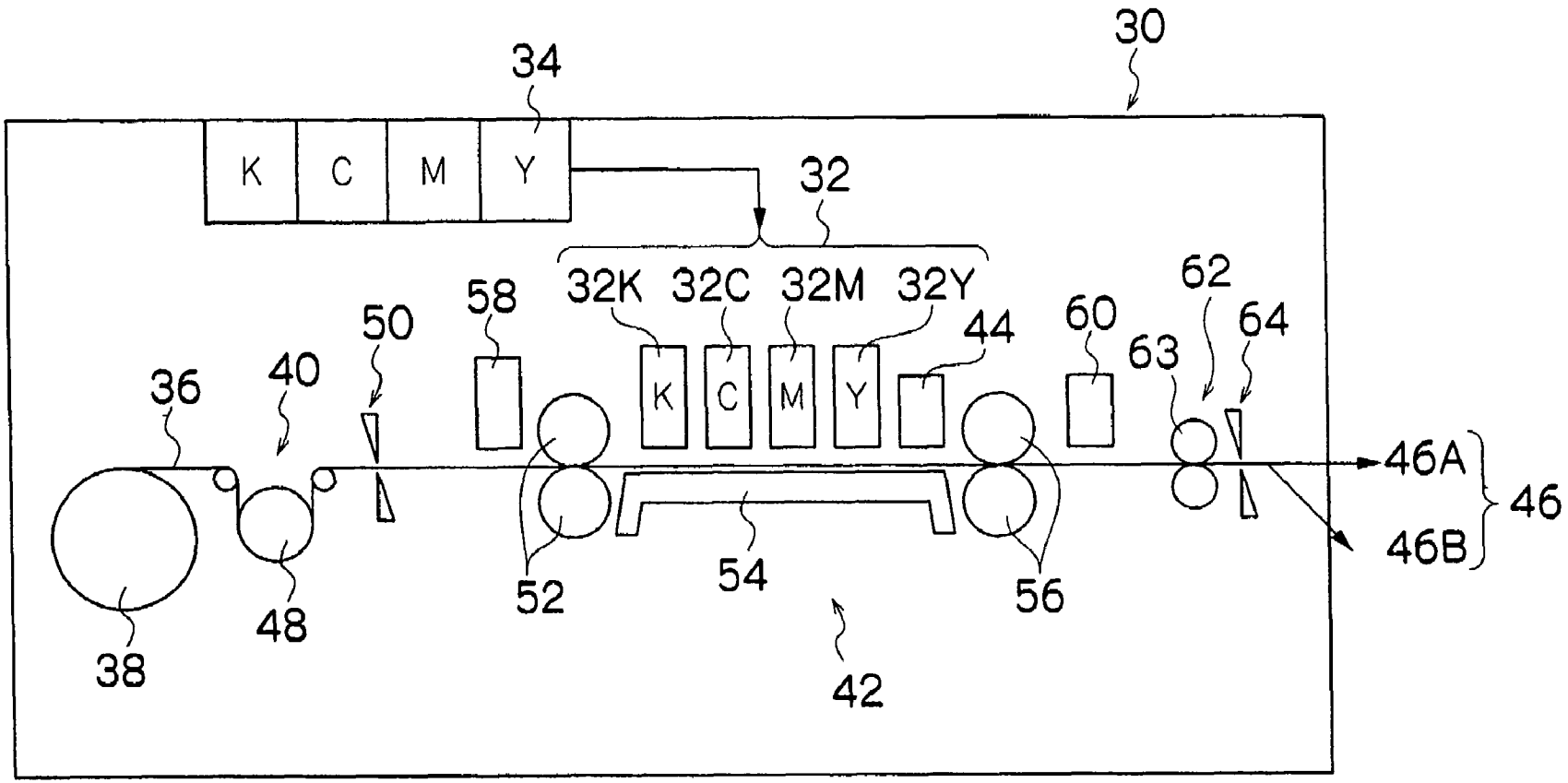
FIG. 4 is a general schematic drawing showing the general composition of an image forming apparatus comprising a mist ejection head according to the one embodiment.

FIG. 4 shows the general composition of the image forming apparatus comprising a mist ejection head of this kind.

As shown in FIG. 4, the image forming apparatus 30 shown in FIG. 4 comprises: a mist ejection unit 32 having a plurality of mist ejection heads 32K, 32C, 32M and 32Y provided for ink colors of black (K), cyan (C), magenta (M) and yellow (Y), respectively; an ink storing and loading unit 34 for storing inks to be supplied to the mist ejection heads 32K, 32C, 32M and 32Y; a paper supply unit 38 for supplying recording paper 36 forming a recording medium; a decurling unit 40 for removing curl in the recording paper 36; a conveyance unit 42, disposed facing the nozzle face (ink ejection face) of the mist ejection unit 32, for conveying the recording paper 36 while keeping the recording paper 36 flat; an ejection determination unit 44 for reading in the ejection result produced by the mist ejection unit 32; and a paper output unit 46 for outputting recorded recording paper (printed matter) to the exterior.

The ink storing and loading unit 34 has ink tanks for storing the inks of the colors corresponding to the mist ejection heads 32K, 32C, 32M and 32Y, and the tanks are connected to the heads 32K, 32C, 32M and 32Y by means of prescribed channels.

In FIG. 4, a magazine for rolled paper (continuous paper) is shown as an example of the paper supply unit 38; however, a plurality of magazines with papers of different paper width and quality may be jointly provided. Moreover, papers may be supplied in cassettes which contain cut papers loaded in layers and which are used jointly or in lieu of magazines for rolled papers.

The recording paper 36 delivered from the paper supply unit 38 retains curl due to having been loaded in the magazine. In order to remove the curl, heat is applied to the recording paper 36 in the decurling unit 40 by a heating drum 48 in the direction opposite to the curl direction in the magazine.

In the case of the configuration in which roll paper is used, a cutter (a first cutter) 50 is provided as shown in FIG. 4, and the roll paper is cut into a desired size by the cutter 50. When cut paper is used, the cutter 50 is not required.

After decurling, the cut recording paper 36 is nipped and conveyed by the pair of conveyance rollers 52, and is supplied onto the platen 54. A pair of conveyance rollers 56 is also disposed on the downstream side of the platen 54 (the downstream side of the mist ejection unit 32), and the recording paper 36 is conveyed at a prescribed speed by the joint action of the front side pair of conveyance rollers 52 and the rear side pair of conveyance rollers 56.

The platen 54 functions as a member (recording medium supporting device) which holds the recording paper 36 (supporting same from below), while keeping the recording paper 36 flat, as well as functioning as a rear surface electrode for attracting the ink mist ejected from the mist ejection unit 32 and causing same to be deposited on the recording paper 36. The platen 54 in FIG. 4 has a width dimension which is greater than the width of the recording paper 36, and at least the portion of the platen 54 opposing the nozzle surface of the mist ejection unit 32 and the sensor surface of the ejection determination unit 44 is a horizontal surface (flat surface).

A heating fan 58 is provided in the conveyance path of the recording paper 36, on the upstream side of the mist ejection unit 32. This heating fan 58 blows heated air onto the recording paper 36 before ink is ejected onto the paper and thereby heats up the recording paper 36. Heating the recording paper 36 immediately before ink ejection has the effect of making the ink dry more readily after landing on the paper.

Figure 5:
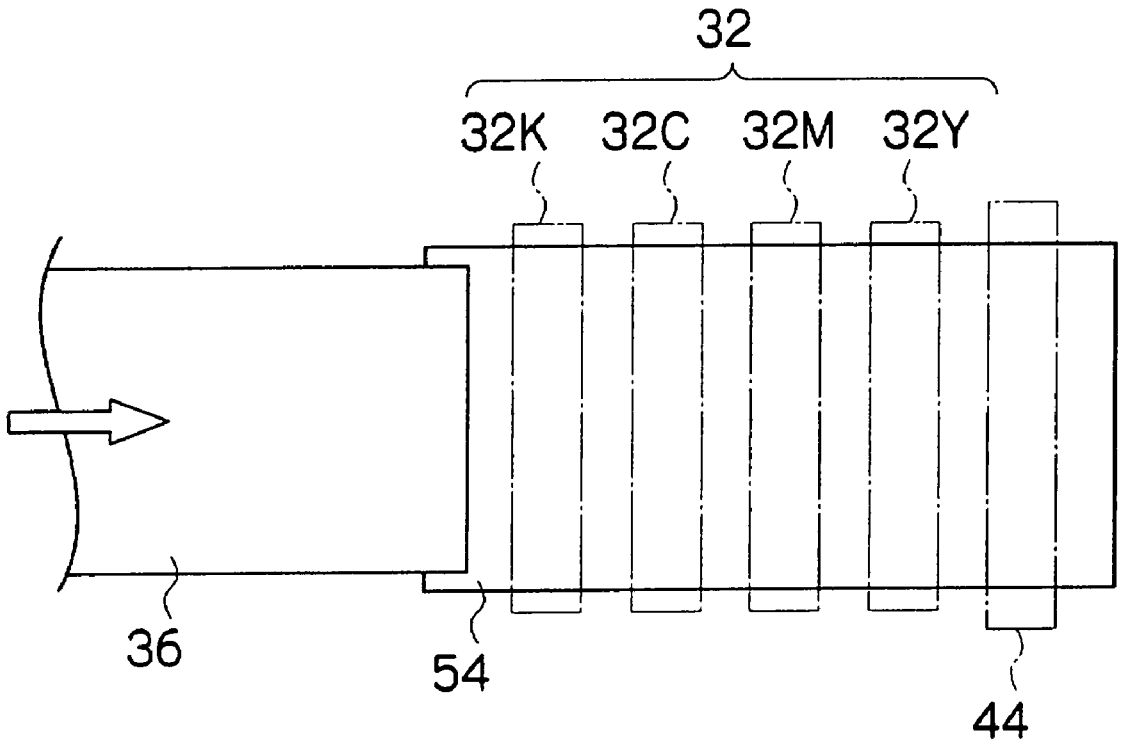
FIG. 5 is an enlarged diagram of the periphery of a mist ejection unit of the image forming apparatus shown in FIG. 4.

FIG. 5 shows an enlarged view of the periphery of the mist ejection head 32. As shown in FIG. 5, the mist ejection heads 32K, 32C, 32M and 32Y of the mist ejection unit 32 are full line heads having a length corresponding to the maximum width of the recording paper 36 used with the image forming apparatus 30, and comprising a plurality of nozzles for ejecting ink arranged on a nozzle surface through a length exceeding at least one edge of the maximum-size recording paper 36 (namely, the full width of the printable range).

The mist ejection heads 32K, 32C, 32M and 32Y are arranged in color order (black (K), cyan (C), magenta (M) and yellow (Y)) from the upstream side in the delivery direction of the recording paper 36, and these mist ejection heads 32K, 32C, 32M and 32Y are fixed extending in a direction substantially perpendicular to the conveyance direction of the recording paper 36.

A color image can be formed on the recording paper 36 by ejecting inks of different colors from the mist ejection heads 32K, 12C, 12M and 12Y, respectively, onto the recording paper 36 while the recording paper 36 is conveyed by the conveyance unit 42.

By adopting a configuration in which the mist ejection heads 32K, 32C, 32M and 32Y having nozzle rows covering the full paper width are provided according to color in this way, it is possible to record an image on the full surface of the recording paper 36 by performing just one operation of moving the recording paper 36 and the mist ejection unit 32, relatively, in the paper conveyance direction (the sub-scanning direction), (in other words, by means of one sub-scanning action). Higher-speed printing is thereby made possible and productivity can be improved in comparison with a shuttle type (serial type) head configuration in which mist ejection heads move reciprocally in a direction which is perpendicular to the paper conveyance direction.

Although a configuration with the four standard colors, K, C, M and Y, is described in the present embodiment, the combinations of the ink colors and the number of colors are not limited to these, and light and/or dark inks, or special color inks can be added as required. For example, a configuration is also possible in which mist ejection heads for ejecting light-colored inks such as light cyan and light magenta are added. Furthermore, there are no particular restrictions on the sequence in which the mist ejection heads of the respective colors are arranged.

The ejection determination unit 44 reads in a test pattern or an actual image formed by the mist ejection heads 32K, 32C, 32M and 32Y of the respective colors, and examines the ejection result.

Returning again to FIG. 4, a post-drying unit 60 is provided on the downstream side of the ejection determination unit 44. The post-drying unit 60 is a device for drying the surface of the image formed on the recording paper 36, and it may comprise, for example, a heating fan.

A heating/pressurizing unit 62 is disposed following the post-drying unit 60. The heating/pressurizing unit 62 is a device to control the glossiness of the image surface, and the image surface is pressed with a pressure roller 63 having a predetermined uneven surface shape while the image surface is heated, and the uneven shape is transferred to the image surface.

The printed object generated in this manner is output via the paper output unit 46. Desirably, the actual image that is to be printed (the printed copy of the desired image), and test images, are output separately. In the inkjet recording apparatus 30 according to the present embodiment, a sorting device (not shown) is provided for switching the outputting pathway in order to sort the printed matter with the target print and the printed matter with the test image, and to send them to output units 46A and 46B, respectively. If the main image and the test image are formed simultaneously in a parallel fashion, on a large piece of printing paper, then the portion corresponding to the test image is cut off by means of the cutter (second cutter) 64. Although not shown in FIG. 4, the paper output unit 46A for the target prints is provided with a sorter for collecting prints according to print orders.

Figure 6:
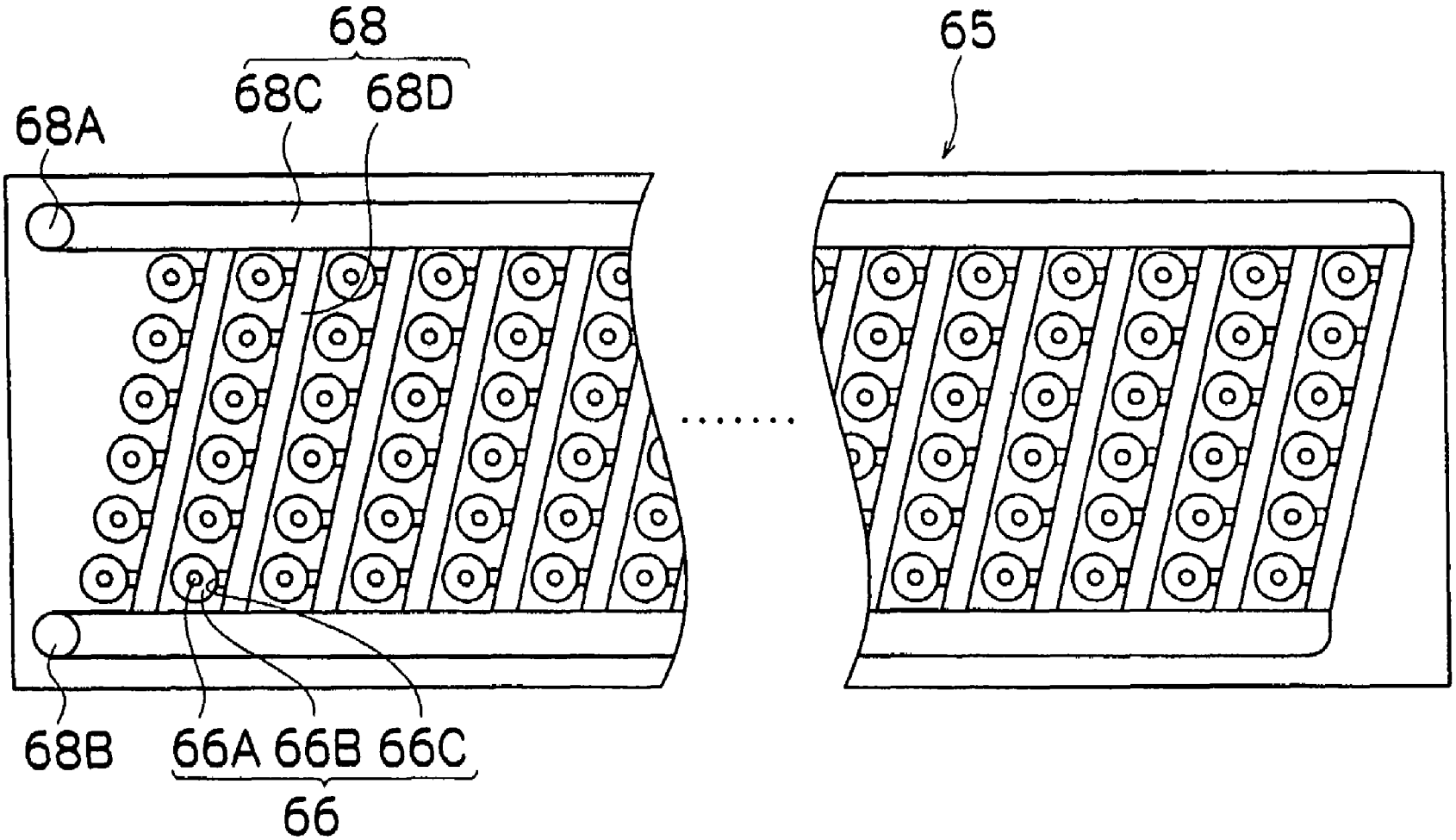
FIG. 6 is a plan view perspective diagram showing one example of a mist ejection head.

FIG. 6 is a plan view perspective diagram showing one example of the mist ejection heads 32K, 32C, 32M and 32Y. The mist ejection heads 32K, 32C, 32M and 32Y all have the same structure, and therefore a representative example of the mist ejection heads is labeled here with the reference numeral 65.

As shown in FIG. 6, the mist ejection head 65 has a structure in which a plurality of ink chamber units (mist ejection elements) 66, each comprising a nozzle 66A forming an ink spraying port, an ink chamber 66B corresponding to the nozzle 66A, and an individual supply channel 66C, are arranged in the form of a two-dimensional matrix, and hence the effective nozzle interval (the projected nozzle pitch) as projected in the lengthwise direction of the mist ejection head 65 (the direction perpendicular to the paper conveyance direction) is reduced (high nozzle density is achieved). In FIG. 6, in order to simplify the drawing, a portion of the ink chamber units 66 is omitted from the drawing.

The ink chambers 66B are connected to a common flow channel 68 via the individual supply channels 66C. The common flow channel 68 is connected to an ink tank which acts as an ink source (not shown in FIG. 6; equivalent to the ink storing and loading unit 34 shown in FIG. 4) via the connection ports 68A and 68B, and the ink supplied from the ink tank is distributed and supplied to the ink chambers 66B of the channels via the common flow channel 68 in FIG. 6. The reference numeral 68C in FIG. 6 indicates a main flow path of the common flow channel 68 and the reference numeral 68D indicates a divergence flow path which branches from the main flow path 68C.

Figure 7:
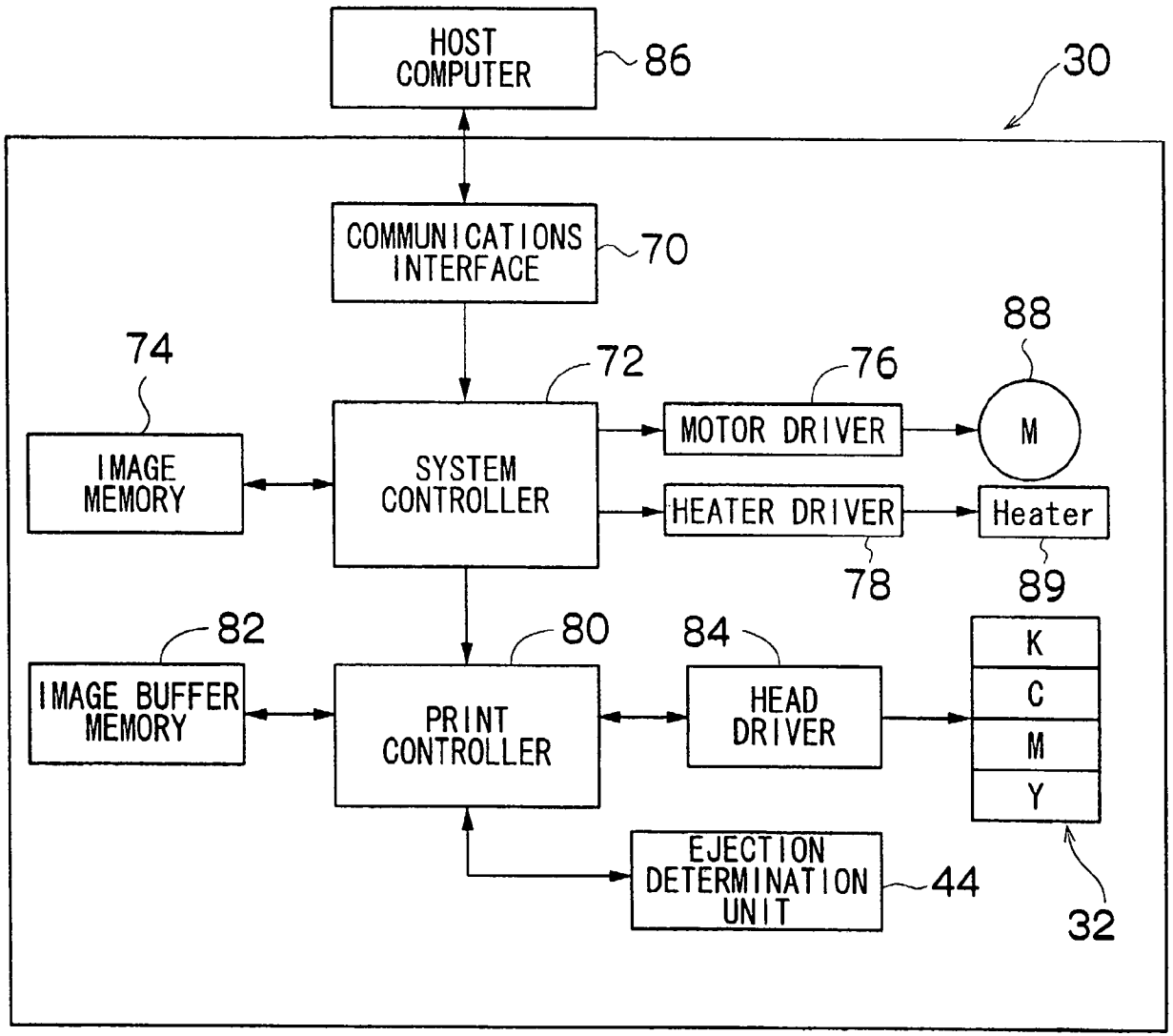
FIG. 7 is a partial block diagram showing the system composition of an image forming apparatus according to one embodiment.

FIG. 7 is a principal block diagram showing the system configuration of the image forming apparatus 30. The image forming apparatus 30 comprises a communication interface 70, a system controller 72, an image memory 74, a motor driver 76, a heater driver 78, a print controller 80, an image buffer memory 82, a head driver 84, and the like.

The communication interface 70 is an interface unit for receiving image data sent from a host computer 86. A serial interface such as USB, IEEE1394, Ethernet (registered trademark), wireless network, or a parallel interface such as a Centronics interface may be used as the communication interface 70. A buffer memory (not shown) may be mounted in this portion in order to increase the communication speed. The image data sent from the host computer 86 is received by the image forming apparatus 30 through the communication interface 70, and is temporarily stored in the image memory 74. The image memory 74 is a storage device for temporarily storing images inputted through the communication interface 70, and data is written and read to and from the image memory 74 through the system controller 72. The image memory 74 is not limited to a memory composed of semiconductor elements, and a hard disk drive or another magnetic medium may be used.

The system controller 72 is a control unit for controlling the various sections, such as the communications interface 70, the image memory 74, the motor driver 76, the heater driver 78, and the like. The system controller 72 is constituted by a central processing unit (CPU) and peripheral circuits thereof, and the like, and in addition to controlling communications with the host computer 86 and controlling reading and writing from and to the image memory 74, and the like, it also generates control signals for controlling the motor 88 of the conveyance system and the heater 89.

The motor driver (drive circuit) 76 drives the motor 88 in accordance with commands from the system controller 72. The heater driver (drive circuit) 78 drives the heater 89 of the post-drying unit 60 and the like in accordance with commands from the system controller 72.

The print controller 80 has a signal processing function for performing various tasks, compensations, and other types of processing for generating print control signals from the image data stored in the image memory 74 in accordance with commands from the system controller 72 so as to supply the generated print control signal (print data) to the head driver 84. Required signal processing is carried out in the print controller 80, and the ejection amount and the ejection timing of the ink droplets from the mist ejection unit 32 are controlled via the head driver 84, on the basis of the print data. By this means, desired dot size and dot positions can be achieved.

The print controller 80 is provided with the image buffer memory 82; and image data, parameters, and other data are temporarily stored in the image buffer memory 82 when image data is processed in the print controller 80. The aspect shown in FIG. 7 is one in which the image buffer memory 82 accompanies the print controller 80; however, the image memory 74 may also serve as the image buffer memory 82. Also possible is an aspect in which the print controller 80 and the system controller 72 are integrated to form a single processor.

The head driver 84 drives the ultrasonic wave generating devices of the mist ejection unit 32, on the basis of the print data supplied from the print controller 80. A feedback control system for maintaining constant drive conditions for the heads may be included in the head driver 84.

As shown in FIG. 4, the ejection determination unit 44 is a block including a line sensor (not illustrated), which reads in the image printed onto the recording paper 36, performs various signal processing operations, and the like, and determines the print situation (presence/absence of ejection, variation in droplet ejection, and the like). The print determination unit 24 supplies these determination results to the print controller 80.

According to requirements, the print controller 80 makes various corrections with respect to the mist ejection head 32 on the basis of information obtained from the ejection determination section 44.

As described above, according to the present embodiment, since the portion of a parabola towards the side of the apex from the focal point is used as the reflector of the mist ejection head, then it is possible to restrict the diameter (outlet diameter) of the outlet side of the reflector, to the nozzle diameter at minimum, and furthermore, there is no consequent lengthening of the propagation distance of the ultrasonic wave. Therefore, it is possible to improve the effective focusing factor in comparison with the related art.

Moreover, by providing a mist ejection head of this kind in an image forming apparatus, it is possible to form images efficiently.

Mist ejection heads according to the present invention, and an image forming apparatus and liquid ejection apparatus comprising same, have been described in detail above, but the present invention is not limited to the aforementioned examples, and it is of course possible for improvements or modifications of various kinds to be implemented, within a range which does not deviate from the essence of the present invention.

It should be understood that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A mist ejection head, comprising:

a nozzle plate in which a nozzle hole for ejecting liquid is formed;

a liquid chamber connected to the nozzle hole;

an ultrasonic wave generating device which applies an ultrasonic wave to the liquid in the liquid chamber, wherein the ultrasonic wave generating device abuts the nozzle plate; and a reflective wall which reflects the ultrasonic wave applied to the liquid, wherein:

the reflective wall is disposed so as to oppose the nozzle plate and has an axially symmetrical shape comprising a portion of a parabolic surface, the portion including an apex of the parabolic surface and being on an apex side with respect to a focal point of the parabolic surface;

an axis of the parabolic surface passes through the nozzle hole; and the focal point of the parabolic surface is positioned in a vicinity of the nozzle hole, wherein the ultrasonic wave generating device is disposed in a vicinity of the nozzle hole on an opposite side of the nozzle plate from the liquid chamber, in such a manner that the ultrasonic wave generated by the ultrasonic wave generating device is applied to the liquid in the liquid chamber via the nozzle plate, travels in parallel to the axis toward the reflective wall, is reflected by the reflective wall and focuses at the focal point.

2. The mist ejection head as defined in claim 1, wherein a supply channel which supplies the liquid to the liquid chamber is formed between a liquid chamber plate in which the liquid chamber is formed, and the nozzle plate, on a side adjacent to the nozzle plate.

3. An image forming apparatus comprising the mist ejection head as defined in claim 1.

4. A liquid ejection apparatus comprising the mist ejection head as defined in claim 1.

5. The mist ejection head as recited in claim 1, wherein the ultrasonic wave generating device is adjacent to the nozzle hole.

* * * * *